US006846195B2

(12) United States Patent
Annequin

(10) Patent No.: US 6,846,195 B2
(45) Date of Patent: Jan. 25, 2005

(54) HOUSING FOR A COAXIAL CONNECTOR ELEMENT, AND A COAXIAL CONNECTOR ELEMENT

(75) Inventor: Sébatien Annequin, Saint Laurent du Pont (FR)

(73) Assignee: Radiall, Rosny sous Bois (FR)

( * ) Notice: Subject to any disclaimer, the term of this patent is extended or adjusted under 35 U.S.C. 154(b) by 0 days.

(21) Appl. No.: 10/618,843

(22) Filed: Jul. 14, 2003

(65) Prior Publication Data

US 2004/0053531 A1 Mar. 18, 2004

(30) Foreign Application Priority Data

Jul. 16, 2002 (FR) ..... 02 08970

(51) Int. Cl.[7] ..... H01R 13/627
(52) U.S. Cl. ..... 439/352; 439/578
(58) Field of Search ..... 439/352–355, 439/578–580, 532, 535

(56) References Cited

U.S. PATENT DOCUMENTS 4,884,978 A 12/1989 Inaba et al.
5,641,300 A 6/1997 Corrion
5,807,129 A * 9/1998 Konda et al. ..... 439/348
6,077,101 A * 6/2000 Garretson et al. ..... 439/352
6,450,829 B1 * 9/2002 Weisz-Margulescu ..... 439/352
6,537,099 B2 * 3/2003 Herlinger et al. ..... 439/352
6,638,096 B1 * 10/2003 Jones et al. ..... 439/352
6,644,996 B2 * 11/2003 Yamashita ..... 439/352
6,659,789 B2 * 12/2003 Nagamine et al. ..... 439/352

FOREIGN PATENT DOCUMENTS

DE 199 29 672 1/2001

* cited by examiner

*Primary Examiner*—Truc Nguyen
(74) *Attorney, Agent, or Firm*—Schweitzer Cornman Gross & Bondell LLP

(57) ABSTRACT

The present invention provides a housing for a coaxial connector element, the housing comprising:

a body suitable for receiving a coaxial contact element;

a locking member configured to co-operate with a shape of a complementary coaxial connector element, and movable between a locking position and an unlocked position; and a blocking member movable between a blocking position preventing the locking member from unlocking, and a disengaged position allowing the locking member to be unlocked, the blocking member being made integrally with the body.

13 Claims, 3 Drawing Sheets

HOUSING FOR A COAXIAL CONNECTOR ELEMENT, AND A COAXIAL CONNECTOR ELEMENT

The present invention relates to a housing for a coaxial connector element, and to a coaxial connector element including such a housing, suitable for use in particular in telecommunications applications in motor vehicles.

BACKGROUND OF THE INVENTION

U.S. Pat. No. 4,714,433 discloses assembling together two electrical connector elements each having a locking arm. One of the locking arms is made integrally with the body of the corresponding electrical connector element, said arm being elastically deformable. The other locking arm is constituted by a separate piece pivotally mounted on the body of the other connector element. The arms are suitable for co-operating by snap-fastening to lock the assembly together.

U.S. Pat. No. 4,941,839 also discloses a locking device for an electrical connector including a piece that is pivotally mounted on a housing and elastically biased by means of a spring.

The connectors described in the two above-mentioned patents are of relatively complex structure.

In addition, U.S. Pat. No. 5,487,678 describes a locking device for an electrical connector, one of the connector elements having an elastically deformable tab suitable for co-operating with a shape on the other connector element. Unlocking is performed by exerting an upwardly-directed force on the resilient tab. That device does not enable accidental unlocking to be prevented.

OBJECTS AND SUMMARY OF THE INVENTION

The present invention seeks to remedy the above-mentioned drawbacks of known connectors in full or in part.

The invention provides a housing for a coaxial connector element, the housing comprising:

- a body suitable for receiving a coaxial contact element;
- a locking member configured to co-operate with a shape of a complementary coaxial connector element, and movable between a locking position and an unlocked position; and
- a blocking member movable between a blocking position preventing the locking member from unlocking, and a disengaged position allowing the locking member to be unlocked.

Because of the simultaneous presence of the locking member and the blocking member, double locking is obtained which reliably prevents the assembled-together connector elements being unlocked accidentally.

In addition, since the members providing double locking are made on a single piece, i.e. the housing, they can be of relatively simple structure.

In an embodiment of the invention, the blocking member is made integrally with the body.

Thus, the housing is relatively simple and inexpensive to manufacture and the double locking can be obtained without any additional part other than the housing.

In a particular embodiment of the invention, the blocking member is connected to the body by a web of material forming a hinge.

The blocking member may be configured to be capable of pivoting through an angular sector of at least 90°.

The locking member may comprise a locking arm configured to be capable of rocking about a bridge of material connecting the arm to the body.

The locking arm may include a handle portion enabling an operator to rock it.

In an embodiment of the invention, the blocking member comprises a wall suitable for being positioned over a portion of the locking arm so as to prevent it from rocking towards the unlocked position.

The locking arm may include an opening configured to co-operate with a shape of a complementary coaxial connector element, and the wall of the blocking member may be configured to cover said opening in the blocking position.

In a particular embodiment, the blocking member includes a first shape suitable for co-operating in its blocking position by snap-fastening with a second shape secured to the body.

The blocking member may include a slot suitable for co-operating in its blocking position by snap-fastening with a tab secured to the body and independent of the locking member.

In an embodiment, the locking member presents a longitudinal axis and the blocking member is configured to be capable of pivoting about an axis parallel to the longitudinal axis of the locking member.

The blocking member may be configured so that in the blocking position it extends substantially over the entire width of the body.

The blocking member may include at least one stiffening rib.

In an embodiment, the housing is made integrally by molding a plastics material, e.g. polyamide 6 or polybutylene terephthalate (PBT).

The invention also provides a coaxial connector element configured for assembly with a complementary coaxial connector element, and comprises:

- a housing as defined above; and
- a coaxial contact element.

The invention also provides a method of making a housing as defined above, comprising the step consisting in molding the housing with the blocking member in the disengaged position.

The invention also provides a method of assembling two coaxial connector elements, one of the coaxial connector elements including a housing as defined above, the method comprising the steps consisting in:

- bringing the blocking member of the housing into the disengaged position;
- engaging the connector elements in each other in such a manner as to lock them together with the help of the locking member of the housing; and
- bringing the blocking member into the blocking position.

BRIEF DESCRIPTION OF THE DRAWINGS

Other characteristics and advantages of the present invention appear on reading the following detailed description of a non-limiting embodiment of the invention and on examining the accompanying drawings, in which.

MORE DETAILED DESCRIPTION

Figure 1:
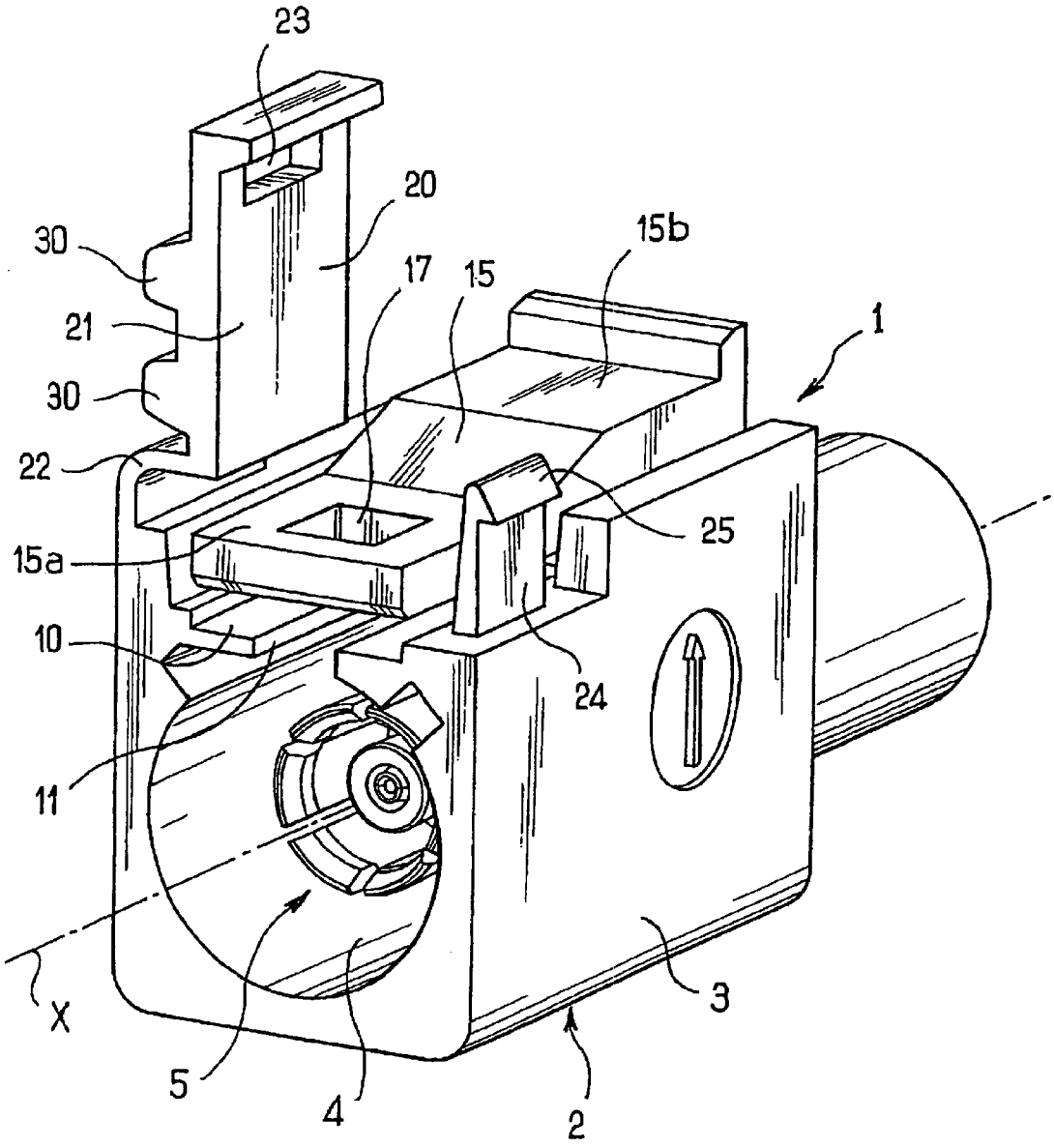
FIG. 1 is a diagrammatic and fragmentary perspective view of a coaxial connector element in accordance with the invention, the blocking member of the housing being in its disengaged position.

FIG. 1 shows a coaxial connector element 1 comprising a housing 2 substantially in the form of a rectangular parallelepiped having a longitudinal axis X.

Figure 3:
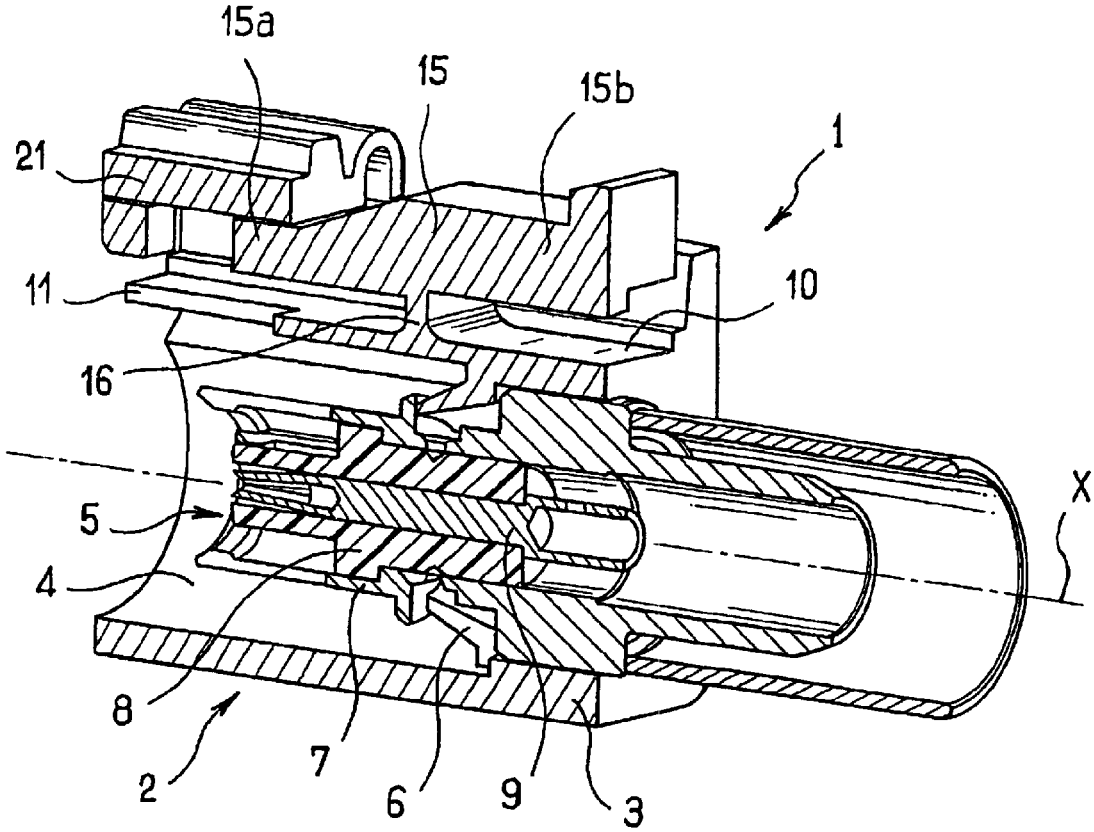
FIG. 3 is a diagrammatic and fragmentary longitudinal section view on II—II of the FIG. 2 connector element.

The housing 2 comprises a body 3 presenting a cavity 4 in which a female coaxial contact element 5 is mounted. The element 5 is retained in the cavity 4 by retaining tabs 6 made on an inside surface of the body 3, as shown in FIG. 3.

In conventional manner, the coaxial contact element comprises an outer conductor 7, an insulator 8, and a central conductor 9.

The body 3 has a top wall 10 provided with a slot 11 extending from its front free edge.

The housing 2 is provided with a locking arm 15 that is substantially rectangular in shape, extending parallel to the axis X.

The locking arm 15 is connected to the top surface of the wall 10 via a bridge of material 16. This bridge extends perpendicularly to the axis X and defines a support about which the locking arm 5 can rock.

A portion 15*a* of the arm 15 situated in front of the bridge of material 16 has an opening 17.

Figure 4:
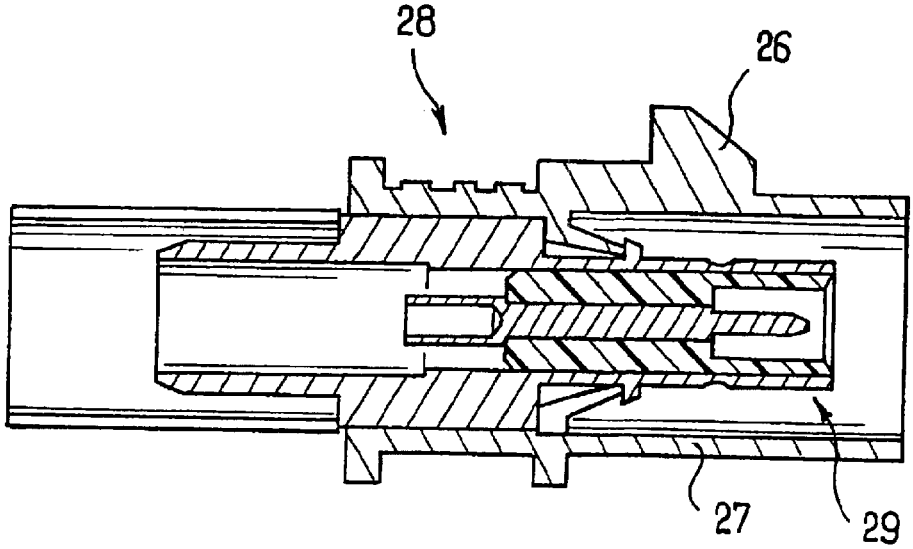
FIG. 4 is a diagrammatic and fragmentary longitudinal section view of a complementary coaxial connector element suitable for being assembled with the coaxial connector element of FIG. 1.

The opening 17 is configured to receive a stud 26 made on a body 27 of a complementary coaxial connector element 28, as shown in FIG. 4.

In conventional manner, the complementary coaxial connector element 28 comprises a male contact element 29 designed to be engaged in the female contact element 5 of the connector 1.

Once the connector elements have been assembled together, the stud 26 is engaged in the slot 11.

A portion 15*b* of the arm 5 situated behind the bridge of material 16 defines a handle portion enabling an operator to rock the arm 15 so as to move it either into a locking position (as shown in the figures), or else into an unlocked position in which the front portion 15*a* is raised.

The housing 2 is also provided with a blocking member 20 comprising a substantially rectangular wall 21 provided with stiffening ribs 30.

This wall 21 is connected to the body 3 along a short side of the rectangle via a web of material 22 forming a hinge, the web of material 22 extending parallel to the axis X. The blocking member 20 is thus movable about the hinge between a disengaged position as shown in FIG. 1, and a blocking position, as shown in FIGS. 2 and 3.

The web of material 22 is of a shape that enables the blocking member 20 pivot through an angular sector of about 90°.

Figure 2:
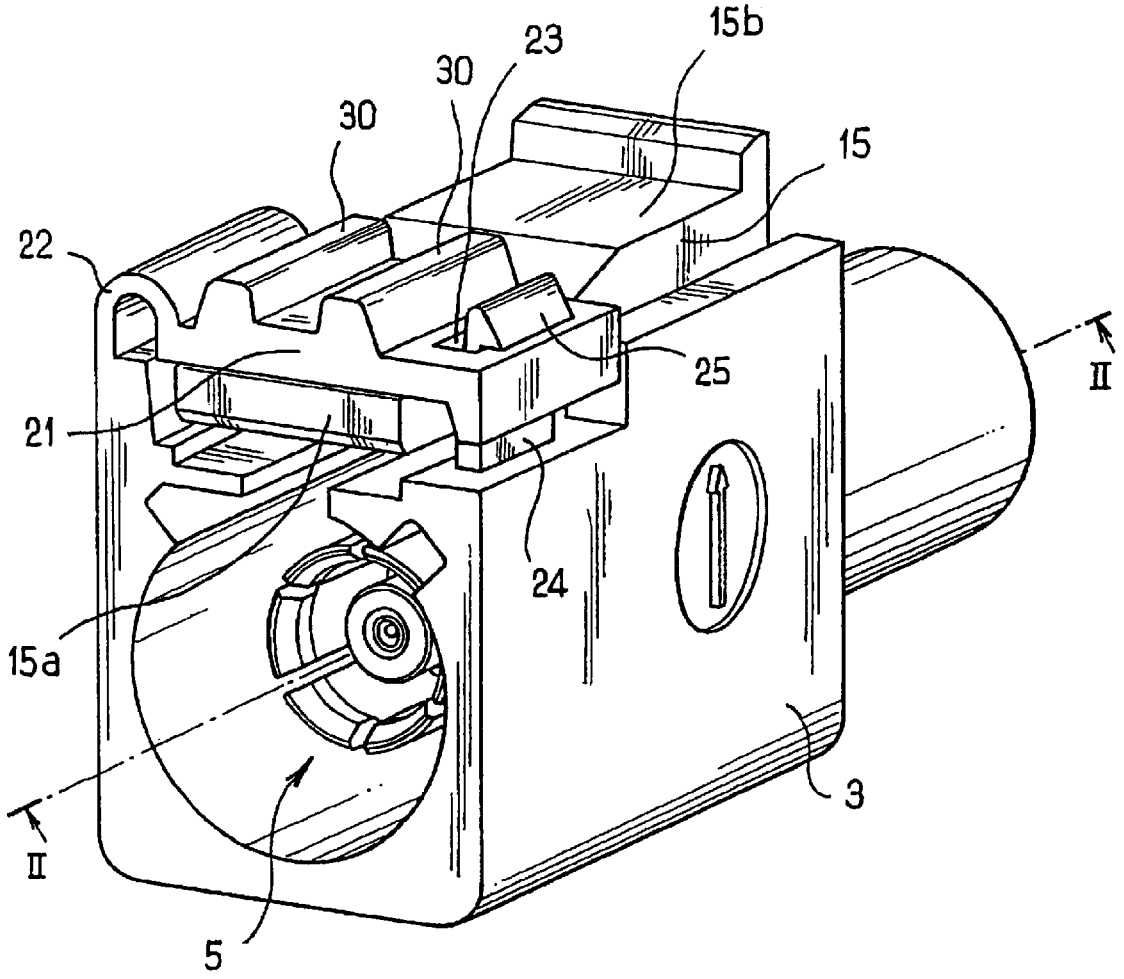
FIG. 2 is a diagrammatic and fragmentary perspective view of the FIG. 1 connector embodiment with the blocking member in the blocking position.

In the blocking position, the wall 21 extends across the arm 15 and covers the front portion 15*a* of the arm 15 over the opening 17, as shown in FIGS. 2 and 3.

The wall 21 has an slot 23 suitable for co-operating with a tab 24 made on the body 2.

The top end of the tab 24 has a catch 25 designed to snap-fasten in the slot 23 of the blocking member 20 in such a manner as to hold the blocking member 20 in its blocking position, as shown in FIG. 2.

In this position, the arm 15 cannot be moved in the unlocking direction, since the wall 21 presents the front portion 15*a* from being moved upwards.

In the example described, the housing 2 is made as a one-piece molding.

The mold used presents a recess enabling the housing 2 to be molded with its blocking member 20 in the disengaged position, i.e. in a position analogous to that shown in FIG. 1.

The connector elements 1 and 28 are assembled together by engaging the body 27 of the connector 28 in the body 3 of the connector 1.

While this is taking place, the blocking member 20 is in its disengaged position, as shown in FIG. 1, so as to allow the arm 15 to rock and allow the stud 26 to be engaged through the slot 11 in the opening 17.

Thereafter, the locking arm 15 returns to its locking position and the user can move the blocking member 20 down onto the snap-fastening tab 24 so as to block the locking arm 15.

The assembly is thus subjected to double locking.

In order to separate the elements of the connector, the user begins by bringing the blocking member 20 into its disengaged position, after which the locking arm 15 can be actuated to release the stud 26 from the opening 17.

What is claimed is:

1. A housing for a coaxial connector element, the housing comprising:

a body suitable for receiving a coaxial contact element;

a locking member configured to co-operate with a shape of a complementary coaxial connector element, and movable about a first axis between a locking position and an unlocked position; and a blocking member movable about a second axis perpendicular to the first axis between a blocking position preventing the locking member from unlocking, and a disengaged position allowing the locking member to be unlocked, the blocking member being made integrally with the body.

2. A housing according to claim 1, wherein the blocking member is connected to the body by a web of material forming a hinge.

3. A housing according to claim 1, wherein the blocking member is configured to be capable of pivoting through an angular sector of at least 90°.

4. A housing according to claim 1, wherein the locking member comprises a locking arm configured to be capable of rocking about a bridge of material connecting the arm to the body.

5. A housing according to claim 4, wherein the locking arm includes a handle portion enabling an operator to rock it.

6. A housing according to claim 4, wherein the blocking member comprises a wall suitable for being positioned over a portion of the locking arm so as to prevent it from rocking towards the unlocked position.

7. A housing according to claim 1, wherein the blocking member includes a first shape suitable for co-operating in its blocking position by snap-fastening with a second shape secured to the body.

8. A housing according to claim 1, wherein the blocking member includes a slot suitable for co-operating in its blocking position by snap-fastening with a tab secured to the body and independent of the locking member.

9. A housing according to claim 1, wherein the locking member presents a longitudinal axis and wherein the blocking member is configured to be capable of pivoting about an axis parallel to the longitudinal axis of the locking member.

10. A housing according to claim 1, wherein the blocking member extends substantially over the entire width of the body when in the blocking position.

11. A housing according to claim 1, the housing being made as a one-piece molding.

12. A coaxial connector element configured for assembly with a complementary coaxial connector element, and comprises:

a housing according to claim 1; and a coaxial contact element.

13. A method of making a housing according to claim 1, the method comprising the step consisting in molding the housing with the blocking member in the disengaged position.

* * * * *

UNITED STATES PATENT AND TRADEMARK OFFICE

CERTIFICATE OF CORRECTION

PATENT NO. : 6,846,195 B2
DATED : January 25, 2005
INVENTOR(S) : Sebastien Annequin It is certified that error appears in the above-identified patent and that said Letters Patent is hereby corrected as shown below:

Title page,
Item [75], Inventor, "Sébatien Annequin" should read -- Sébastien Annequin --.

Signed and Sealed this

Thirty-first Day of May, 2005

JON W. DUDAS
*Director of the United States Patent and Trademark Office*